US006588755B1

(12) United States Patent
Nigale

(10) Patent No.: US 6,588,755 B1
(45) Date of Patent: Jul. 8, 2003

(54) PYRAMID GAME

(76) Inventor: Arvind Nigale, 2/54 Sneh-Sagar MHADA Complex, Film City Road, Malad (East), Mumbai-400 097 (IN)

( * ) Notice: Subject to any disclaimer, the term of this patent is extended or adjusted under 35 U.S.C. 154(b) by 0 days.

(21) Appl. No.: 10/091,198

(22) Filed: Mar. 5, 2002

(51) Int. Cl.[7] ..... A63F 3/00

(52) U.S. Cl. ..... 273/283; 273/287; 273/288; 273/430

(58) Field of Search ..... 273/283, 282.1, 273/287, 241, 276, 282.3, 288, 430

(56) References Cited

U.S. PATENT DOCUMENTS 3,126,205 A * 3/1964 Jordan
4,059,272 A * 11/1977 Pullman ..... 273/130
4,059,273 A * 11/1977 Kindred
4,188,036 A * 2/1980 Jones-Fenleigh

FOREIGN PATENT DOCUMENTS

CA 1009675 * 3/1977
GB 2213392 A * 8/1989 ..... A63F/3/00

* cited by examiner

*Primary Examiner*—Benjamin H. Layno
*Assistant Examiner*—V K Mendiratta
(74) *Attorney, Agent, or Firm*—Brown & Michaels, PC

(57) ABSTRACT

The present invention is a game. The game board used is shaped like a triangle. The board has three sides with at least four primary interlocking base pieces and three secondary interlocking angle pieces connecting the sides, creating a triangular board. The game also uses a plurality of tetrahedra, where four tetrahedron pieces form a pyramid with square base. Each tetrahedron piece has a centralized hole on its face that is showing when a pyramid is formed. The game also includes symbols that can be fixedly attached and removed from the faces of the tetrahedron pieces. At the vertex of the triangular board is a primary base piece which holds one player's chosen combination to be guessed by the other player. The other player tries to guess the combination of symbols, colors, and directions that the player has chosen and hidden behind a shield.

24 Claims, 6 Drawing Sheets

(1 of 6 Drawing Sheet(s) Filed in Color)

PYRAMID GAME

BACKGROUND OF THE INVENTION

1. Field of the Invention

The invention pertains to the field of board games. More particularly, the invention pertains to a game where one player has to guess a combination of elements the opposing player has chosen.

2. Description of Related Art

There are many board games in the prior art that involve successively guessing what a given set of elements are based on feedback regarding prior guessing. One example of such a board game is Mastermind®. Mastermind® is a two player game where one player chooses a combination of colored code pegs, of which there are seven colors, and places four of them in a particular order behind a screen on the rectangular game board. The other player has to guess the combination that is behind the screen. The player guessing the combination only has ten tries. The player guesses by placing the colored code pegs in an order on the rectangular game board. The player that chose the combination responds to each guess by using red and white key pegs to give feedback. The red key peg means that the player's guess has at least one code peg with the correct color in the right position. The white key peg means that the player's guess has the correct colored code peg, but the wrong position for the peg. If the player that chose the combination does not use a key peg for the guess made, then one of the colored code pegs used was not present in the combination that is behind the screen. The guessing and feedback volley continues until a guess is correct, or ten tries have elapsed. The two variables used in the game Mastermind® are color and position, giving 2,401 possible combinations the guessing player has to chose from in order to find the one behind the screen.

SUMMARY OF THE INVENTION

The present invention is a game that offers different game play every time. The game board used to play the game is shaped like a triangle. The game of the present invention does not have just two variable, i.e. color and position like in the prior art, but four variables, consisting of: position of the pieces, color of the pieces, what symbol type, and color of the symbol. The four variables used give 4,294,967,296 combinations the guessing player has to choose from in order to find the one chosen by the opposing player.

The board has three sides with at least four primary interlocking base pieces and three secondary interlocking angle pieces connecting the sides, creating a triangular board. The game also uses a plurality of tetrahedra, which form a pyramid with a square base when put together. Each tetrahedron piece has a centralized hole on its face that is showing when a pyramid is formed. The game also includes symbols that can be fixedly attached and removed from the face of the tetrahedron pieces. At one corner of the triangular board is a raised primary base piece which holds one player's chosen combination to be guessed by the other player. The other player tries to guess the combination of symbols, colors, and positions that the player has chosen and hidden behind a shield. The player guessing the combination only gets fourteen tries. If the player guesses correctly, he/she wins. If the player does not guess the combination correctly in fourteen tries, he/she loses.

BRIEF DESCRIPTION OF THE DRAWING

The patent or application file contains at least one drawing executed in color. Copies of this patent or patent application publication with color drawing(s) will be provided by the U.S. Patent and Trademark Office upon request and payment of the necessary fee.

DETAILED DESCRIPTION OF THE INVENTION

The present invention is a new game. The invention includes both a novel game board and pieces and a novel method of play. The following description provides details of the method of game play first and then the details of the structural board.

The object of the game is to guess the combination of symbols, colors, and positions of the main pieces chosen by another player. The player chooses from eight different animal symbols in eight different colors, four different colored main pieces, and the positions of the main pieces. The player that chose the combination hides his/her choice from the guessing player. The guessing player has to guess the combination chosen within a certain number of tries (e.g. fourteen).

Figure 6:
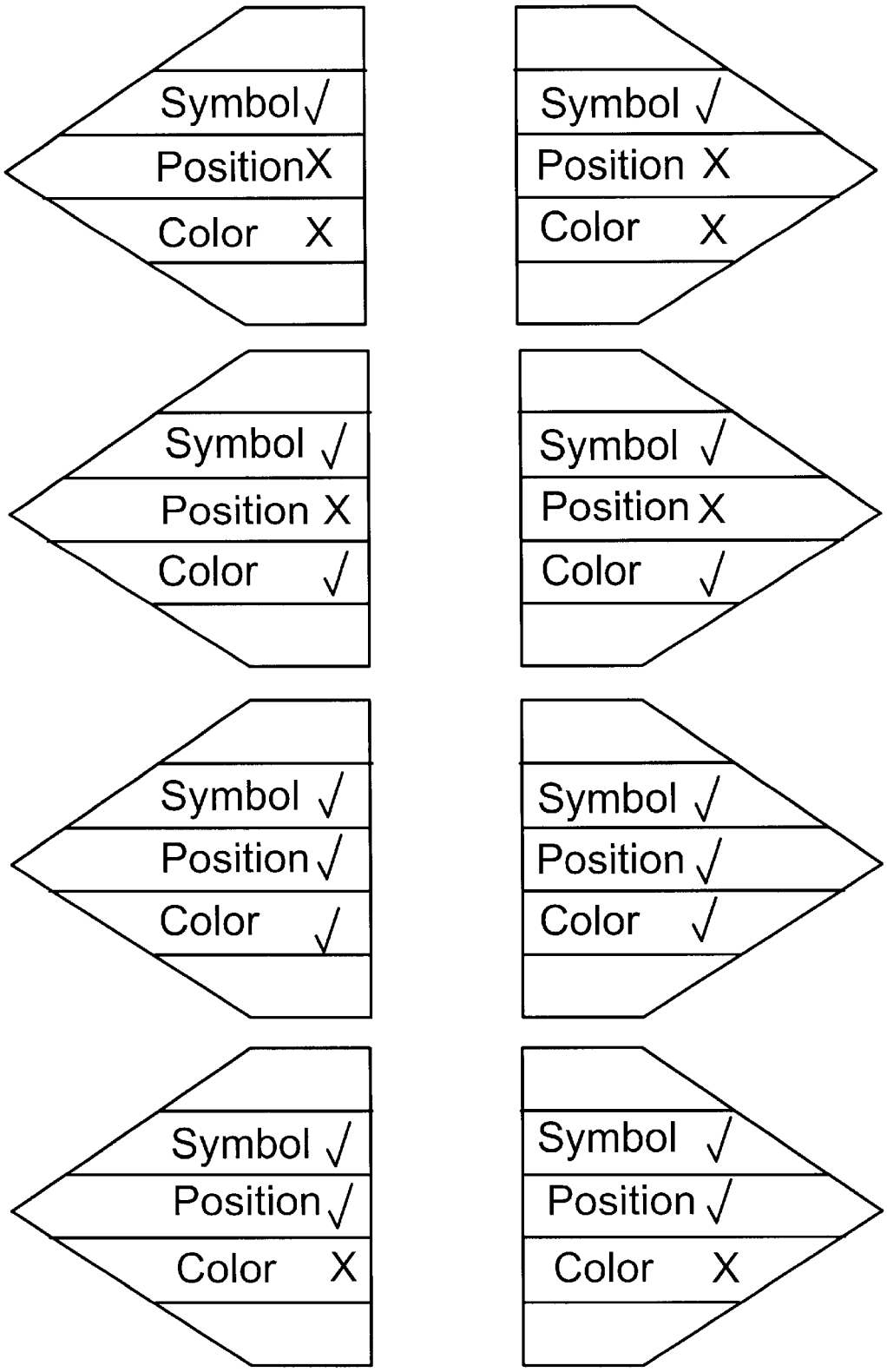
FIG. 6 shows the flag faces used to indicate the correctness of the guess made by an opposing player.

The guessing player chooses a combination of symbols, colors, and positions and displays them for the other player. For every guess the player makes, he/she gets feedback from the player who has chosen the combination. The feedback is given using different types of clue flags. One type of clue flag is a solid color. There are three different solid color clue flags. Each color represents different information. For example, a solid green colored flag indicates that the color and position of the tetrahedron face is correct. An amber colored clue flag indicates the color is correct but the position of the tetrahedron face is incorrect. A red colored flag indicates that the color is incorrect and is not being used in the combination at all. Another type of clue flag contains text. There are eleven text clue flags. These flags indicate information about the symbols, e.g. color, type, and position (FIG. 6). For example, a text clue flag that has an X next to the text color and position, but not symbol, then the symbol type is correct but the color and position of the symbol is incorrect.

After feedback is given for a guess, the player makes another guess by using and interpreting the information obtained from the feedback given by the other player. For example, if the player guessed the correct colors for all of the positions of the main pieces and chose four different animal symbols for each position, all in one color, the player that chose the combination would indicate to the guessing player that the color and positions of all of the main pieces was correct with a green flag for each position and a text flag with an X next to symbol color for each position. The guessing player would interpret this information as saying that the only variable that has to change is the color of each of the symbols chosen for each position. For the guessing player's next turn, he/she displays the exact same guess, only changing the color of the symbols. The player that chose the combination then gives more feedback, so as to further direct and aid the guessing player in making further guesses.

The guessing and feedback repeats until the guessing player guesses the correct combination or a certain number of guesses, which was established previously, has elapsed.

In an alternative embodiment, the number of combinations can be reduced based on the age of the players. For example, if the players were ages six to eight, the guessing player may only have to guess the color and position of the tetrahedron face. The number of attempts the guessing player receives can be increased or decreased. Another example is if the players where ages nine to twelve, the guessing player may only have to guess the color, the position, and the symbol type.

The game can be played on both a structural apparatus, to be described later on in the specification, or on a computer, console, or similar electronic device, where the computer, console, or electronic device is one of the two players. For example, a single player can play the game against the computer, where the computer selects a random a "chosen combination" and provides clues. The game can also be played online (e.g. on the Internet), where one player chooses a combination at a computer terminal located in one geographic location and plays with another player present at a different computer terminal located in a different geographic location. Each player can choose from a menu as to what symbols, symbol color, and color of pieces they wish to count as a guess or as the combination to be guessed by others. Another menu will be available for the player giving feedback. This menu will contain the same flags as described above. Once the player giving the feedback is finished, the flags chosen will appear on the other player's screen. The guessing and feedback repeats until the guessing player guesses the correct combination or a certain number of guesses, which was established previously, has elapsed.

Figure 1:
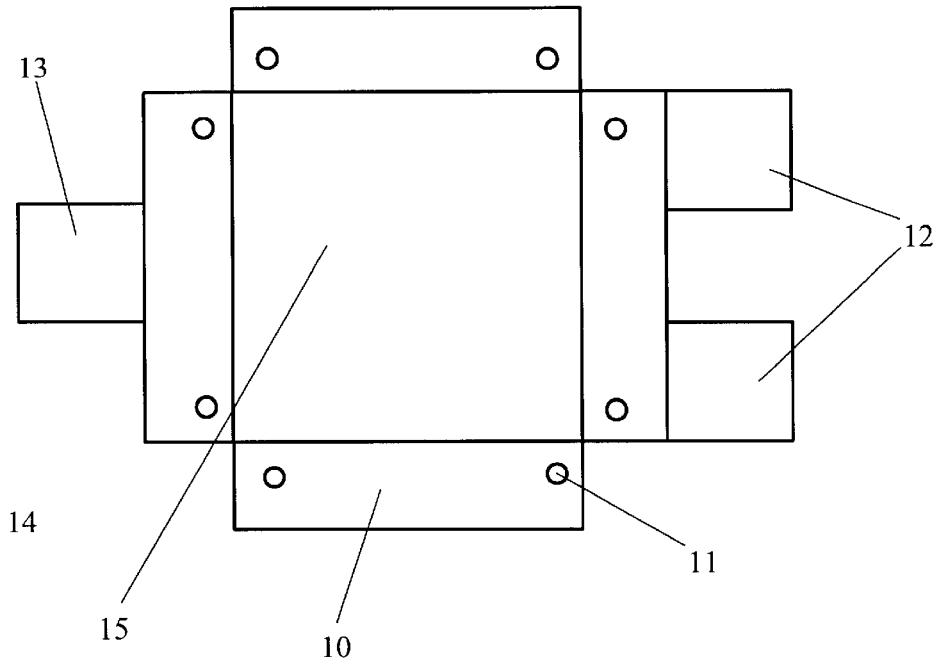
FIG. 1 shows a primary interlocking base piece.

FIGS. 1 through 4 show the structural game board used to play the game. FIG. 1 shows a primary interlocking base piece (14). Each primary interlocking base piece (14) has four rectangular frame pieces (10) (e.g. ⅜"×2"). Each of the rectangular frame pieces (10) has two holes (11) drilled on either side, which are used as a base to hold clue flags in a vertical position. The four rectangular frame pieces (10) form a square enclosure (15) (e.g. 2"×2") that holds four tetrahedron pieces, the four tetrahedron pieces shown in FIG. 3*c*. When the four tetrahedron pieces, shown in FIG. 3*c* are placed together they form a pyramid with a square base, as shown in FIGS. 4*a* and 4*b*. Each primary interlocking base piece has both a "key" (13) and a "lock" (12). On one of the two nonadjacent sides of the square enclosure (15) is a "key" (13). The "key" (13) is fixedly attached to the rectangular frame piece of the side. The "key" (13) is square in shape (e.g. ⅝"×⅝"). A "lock" (12) is present on the other nonadjacent side of the same square enclosure (15). The "lock" (12) comprises two square pieces (e.g. ⅝"×⅝") with a separation between them (e.g. ⅝"). Primary interlocking base pieces (14) interlock by placing the "key" (13) of one primary interlocking base piece in the separation found between the two square pieces that make up a "lock" (12) of another primary interlocking base piece. Six primary interlocking base pieces (14) total contribute to the game board base.

Figure 2:
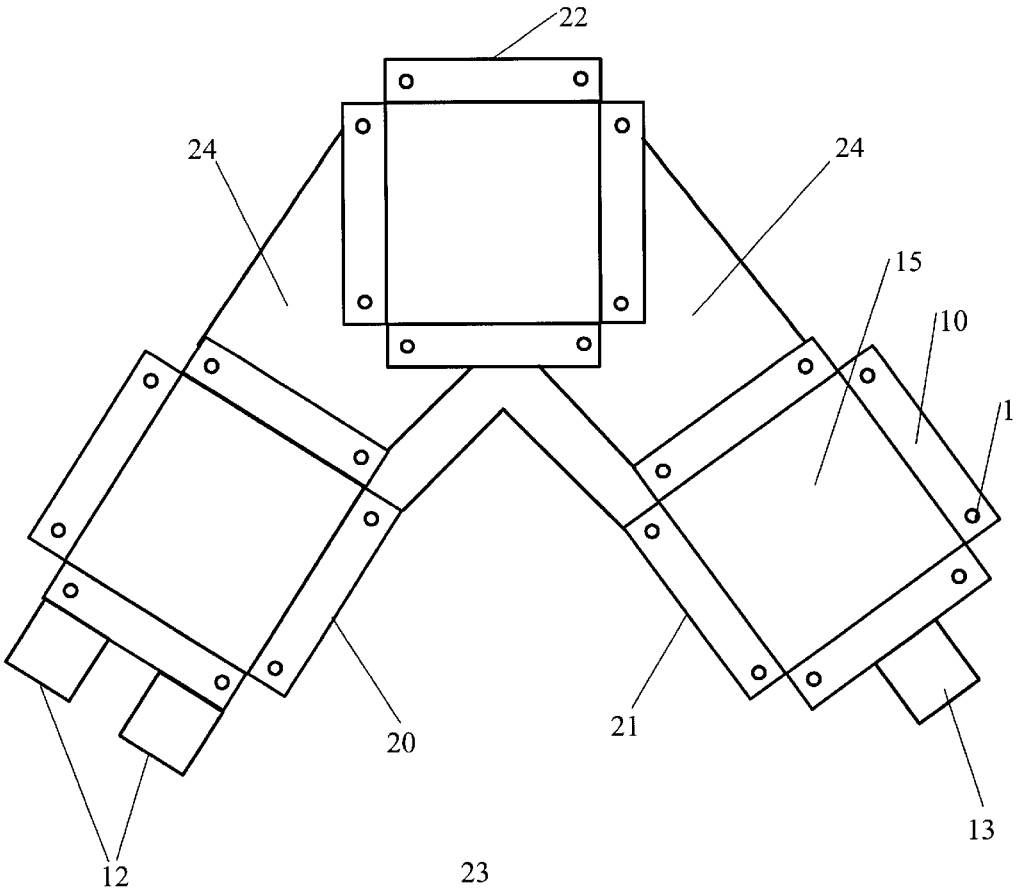
FIG. 2 shows a secondary interlocking angle base piece.
Figure 3C:
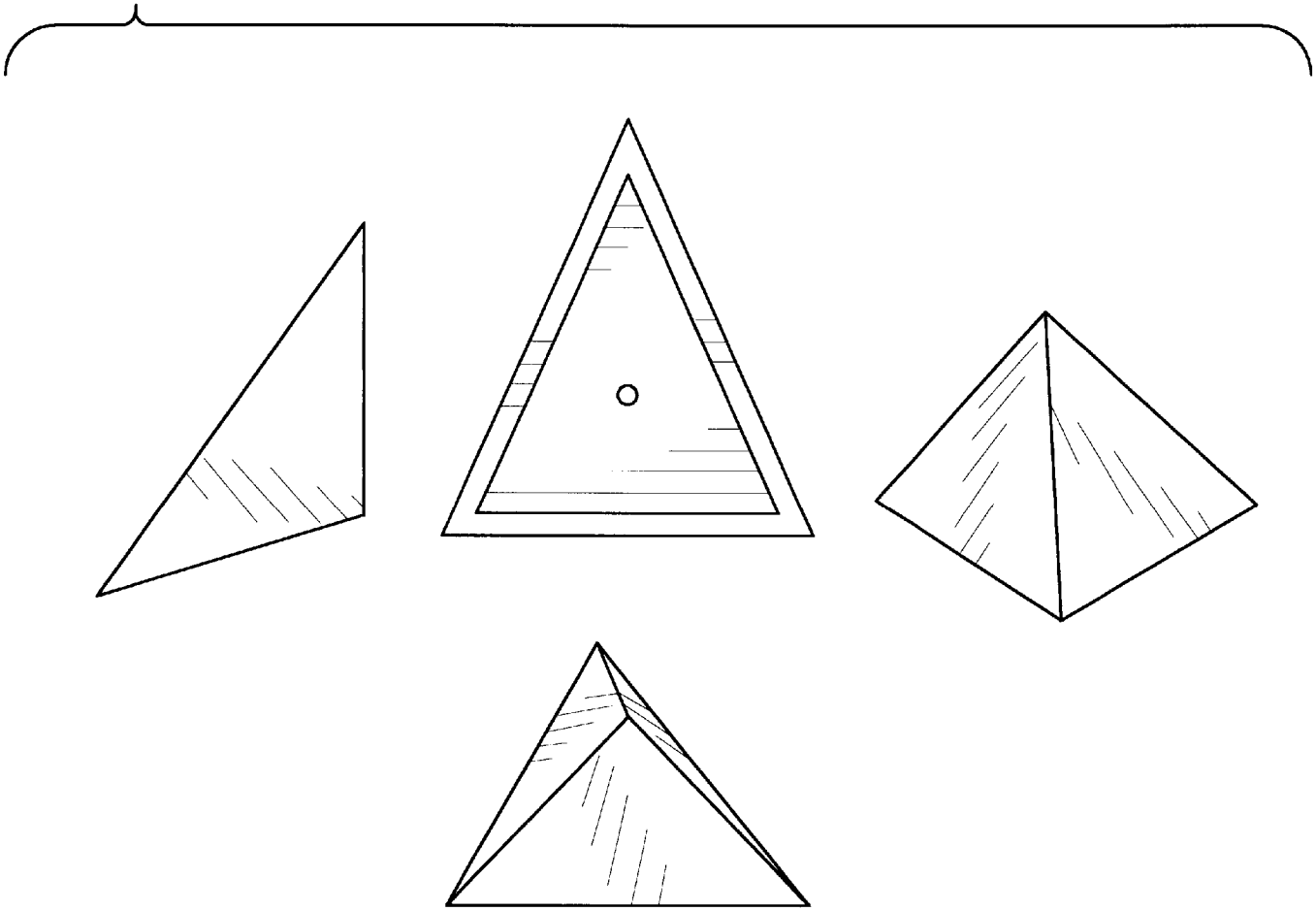
Figure 4A:
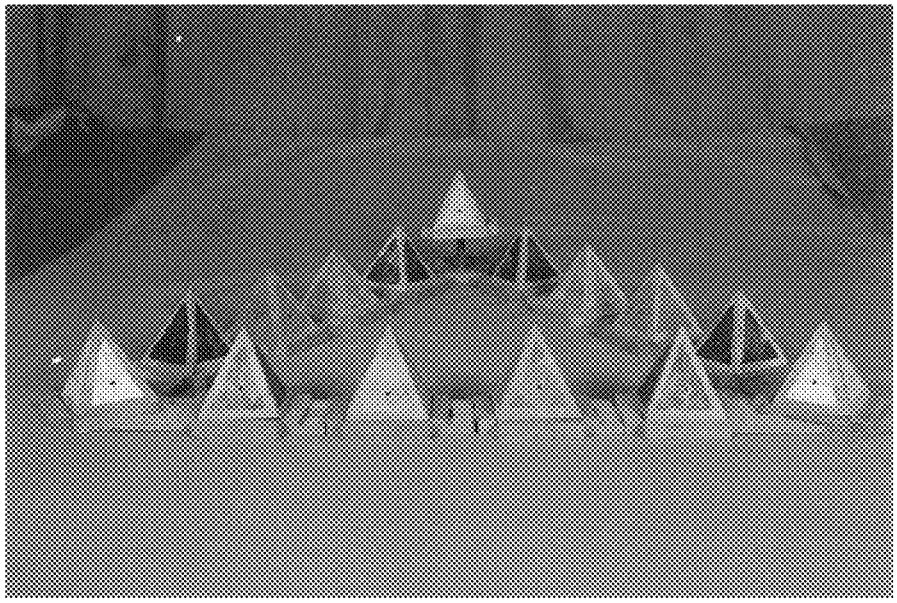
FIGS. 4(A & B) shows a top view and side view of the playing board.
Figure 4B:
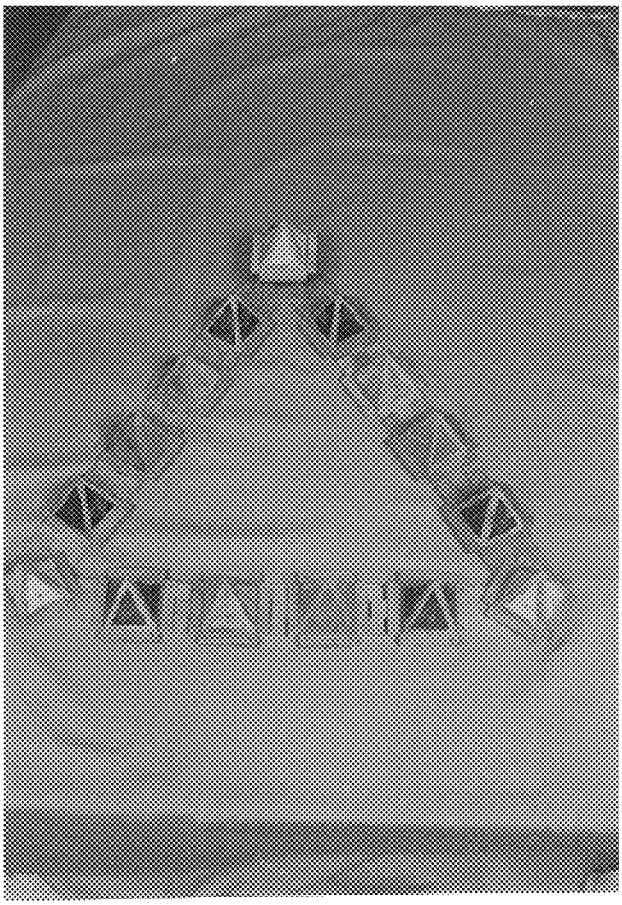

FIG. 2 shows the secondary interlocking angle pieces (23). The secondary interlocking angle pieces (23) form a 60 degree angle and are used at three corners of the triangular game board to connect groups of primary interlocking base pieces (14). Each secondary interlocking angle piece (23) consists of three incomplete primary base pieces (20)(21) (22). At either end of the legs (24) of the secondary interlocking angle pieces (23), is an incomplete primary interlocking base piece (20)(21) with only a "lock" (30) or a "key" (21). The incomplete primary interlocking base pieces (20)(21) has four rectangular frame pieces (10) (e.g. ⅜"×2"). Each of the rectangular frame pieces (10) has two holes (11) drilled on either side, which are used as a base to hold clue flags in a vertical position. The four rectangular frame pieces (10) form a square enclosure (15) (e.g. 2"×2") that holds four tetrahedron pieces. When the four tetrahedron pieces, the tetrahedron pieces shown in FIG. 3*c*, are placed together they form a pyramid with a square base, as shown in FIGS. 4*a* and 4*b*. At the vertex of the angle present in the secondary interlocking angle piece (23) is an incomplete primary interlocking base piece (22) that does not contain either a "lock" (12) or a "key" (13). The incomplete primary interlocking base piece (22) at the vertex of the angle is raised. The incomplete primary interlocking base piece (22) has four rectangular frame pieces (10) (e.g. ⅜"×2"). Each of the rectangular frame pieces (10) has two holes (11) drilled on either side, which are used as a base to hold clue flags in a vertical position. The four rectangular frame pieces (10) form a square enclosure (15) (e.g. 2"×2") that holds four tetrahedron pieces, the tetrahedron pieces shown in FIG. 3*c*. When the four tetrahedron pieces are placed together they form a pyramid with s square base, as shown in FIGS. 4*a* and 4*b*. This incomplete primary interlocking base piece (22) is used by one of the players to display the combination to be guesses by the opposing player. A shield of plastic or material of similar means is placed in front of the raised incomplete primary interlocking base piece to block the view of the player that is guessing. The shield is tall enough and wide enough to discourage all views, but for the one player sitting directly behind the shield.

Figure 3A:
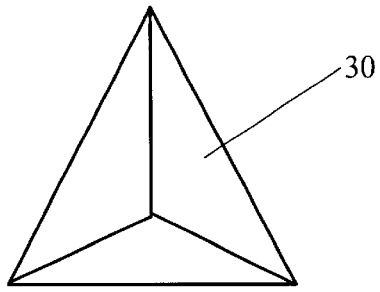
FIGS. 3(A, B, & C) shows the tetrahedron pieces that make up a pyramid.
Figure 3B:
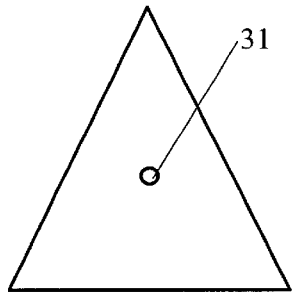

FIG. 3A shows a three-dimensional view of one of the four tetrahedron pieces (30). When four tetrahedron pieces (30) are placed together, they form a pyramid. FIG. 3B shows a face of one of the tetrahedron pieces (30). In the center of the face is centralized hole (31), which is used to capture a protrusion from symbols made of plastic or a similar material. FIG. 3C shows different views of a tetrahedron piece (30), which when put together with three other tetrahedron pieces forms a pyramid.

FIG. 4A shows a top view of the entire triangular game board. FIG. 4B shows a side view of the triangular game board.

Figure 5:
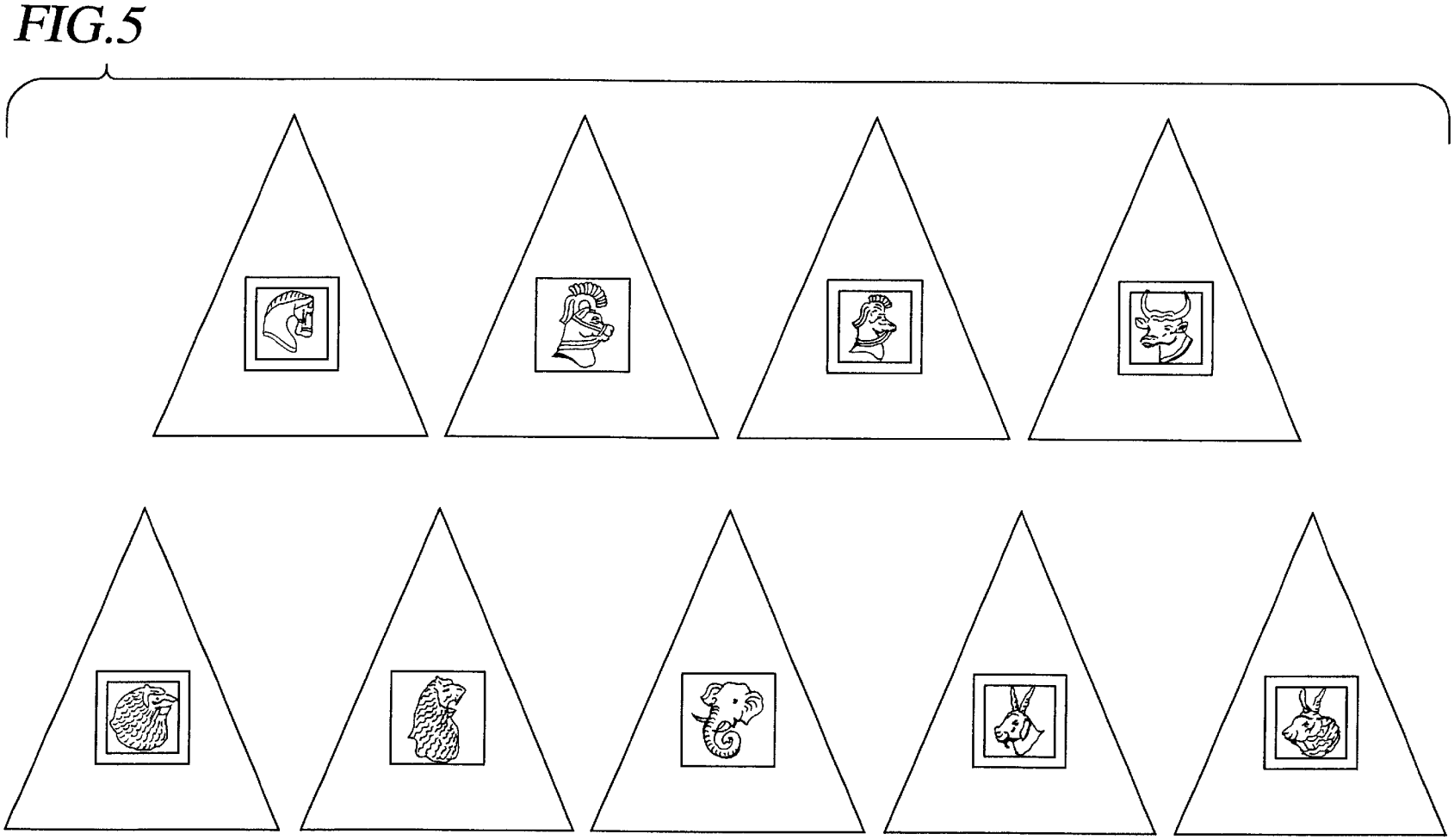
FIG. 5 shows the animal symbols that are placed on the tetrahedron faces.

FIG. 5 shows examples of symbols (e.g. animals) that are placed on the faces of the tetrahedron pieces (30). The symbols are removable. The symbols attach to the tetrahedron faces by pushing a protrusion of the symbols into the hole (31) present on the face of the tetrahedron (FIG. 3B) so that the hole (31) captures the protrusion. The protrusion of the symbol and hole (31) in the tetrahedron face are of the correct size such that the symbols can easily be removed when game play is finished. The symbols come in at least eight different types (e.g. animals), with each symbol type being present in at least eight different colors.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A game comprising:

a) a triangular board containing at least four primary interlocking base pieces on each side of the triangular board and three secondary interlocking angle pieces connecting the sides together;

b) a plurality of tetrahedron pieces that assemble into a pyramid, one face of each of said tetrahedron pieces showing containing a centralized opening; and c) symbols that can be fixedly attached and removed from said faces showing of each of said tetrahedron pieces.

2. The game of claim 1, wherein said primary interlocking base pieces contains:

a) two rectangular frame pieces;

b) one rectangular frame piece with a lock;

c) one rectangular frame piece with a key; and d) wherein said rectangular frame pieces form a square enclosure.

3. The rectangular frame pieces of claim 2 further consisting of two drilled holes on opposing ends of a top face of said rectangular frame piece.

4. The rectangular frame piece with a lock of claim 2, wherein said lock is two square pieces fixedly attached to said rectangular frame piece with a separation between said two squares.

5. The rectangular frame piece with a key of claim 2, wherein said key is a square piece fixedly attached to said rectangular frame piece.

6. The game of claim 1, wherein said secondary interlocking angle pieces contains:

a) one incomplete primary interlocking base piece;

b) one primary interlocking base piece with only a lock; and c) one primary interlocking base piece with only a key.

7. The incomplete primary interlocking base piece of claim 6, wherein said piece is located at a vertex of an angle and consists of four rectangular frame pieces with two drilled holes on opposing ends of a top face of said rectangular frame piece.

8. The primary interlocking base piece with only a lock of claim 6, wherein said lock is two square pieces fixedly attached to said rectangular frame piece with a separation between said two square pieces.

9. The primary interlocking base piece with only a key of claim 6, wherein said key is a square piece fixedly attached to said rectangular frame piece.

10. The game of claim 1, wherein one of said secondary interlocking angle pieces contains a raised incomplete primary interlocking base piece located at a vertex of an angle.

11. The game of claim 1, wherein said faces of tetrahedron pieces are different colors.

12. The game of claim 1, wherein said symbols are animals.

13. The symbols of claim 12, wherein said animals are different colors.

14. The method of playing a game having playing pieces comprising a plurality of tetrahedra, each tetrahedron having faces in at least one color, selected from a plurality of colors for said faces, and a plurality of colored symbols for placement on a tetrahedron face, comprising the steps of:

(a) a first player creating a playing piece by choosing four tetrahedra and at least one symbol in any order:

i) assembling the tetrahedra into a pyramid, one face of each said tetrahedra showing in a chosen position;

ii) applying a symbol to at least one of said tetrahedra face;

b) hiding said playing piece;

c) a second player attempting to duplicate the playing piece created in step (a) by the steps of:

i) assembling the tetrahedra into a pyramid, one face of each said tetrahedra showing in a chosen position;

ii) applying a symbol to at least one of said tetrahedra face;

d) said first player placing different type clue flags adjacent to each tetrahedra face of said playing piece created by said second player, indicating if said adjacent face matches a corresponding face in said playing piece created in step (a);

e) wherein said playing pieces are either physical or represent physical objects in a computer program.

15. The method of claim 14, wherein said steps c) and d) are repeated for a set number until said set number is reached or said combination is guessed correctly.

16. The method of claim 14, wherein said different types of clue flags are colored clue flags and text clue flags.

17. The clue flags of claim 16, wherein said colored clue flags give information regarding color and position of tetrahedra faces chosen by said second player.

18. The clue flags of claim 16, wherein said text clue flags give information regarding symbol type, position, and color of said symbol chosen by said second player.

19. The method of claim 14, wherein said game can be played on a computer, a console, or other similar electronic device.

20. The method of claim 14, wherein either said first player or said player is computer or a console.

21. The method of claim 14, wherein said first player is a person at a computer terminal located in one geographic location and said second player is a different person located at a different computer terminal at a different geographical location.

22. The method of claim 14, wherein said symbols are different colors.

23. The method of claim 22, wherein said symbols are animals.

24. A kit for playing a game comprising:

a) a triangular board containing at least four primary interlocking base pieces on each side of the triangular board and three secondary interlocking angle pieces connecting said sides together;

b) a plurality of tetrahedron pieces that assemble into a pyramid, one face of each of said tetrahedron pieces showing, containing a centralized opening;

c) symbols that can be fixedly attached and removed from said faces showing of each of said tetrahedron pieces; and d) different types of clue flags.

* * * * *